United States Patent [19]

Economopoulos et al.

[11] Patent Number: 4,668,308

[45] Date of Patent: May 26, 1987

[54] METHOD AND APPARATUS FOR MANUFACTURING RAILS

[75] Inventors: Marios Economopoulos, Liege; Nicole Lambert, Waremme; Pierre Simon, Montegnee; René Conti, Athus, all of Belgium

[73] Assignees: Centre de Recherches Metallurgiques-Centrum Voor Research in de Metallurgie; Metallurgique et Miniere de Rodange-Athus S.A., both of France

[21] Appl. No.: 731,717

[22] Filed: May 8, 1985

[30] Foreign Application Priority Data

May 9, 1984 [BE] Belgium ..... 899617

[51] Int. Cl.[4] ..... C21D 9/04

[52] U.S. Cl. ..... 148/12 R; 148/12.4; 148/146; 148/156

[58] Field of Search ..... 148/12 R, 12.4, 128, 148/146, 143, 156

[56] References Cited

U.S. PATENT DOCUMENTS 4,486,243 12/1984 Lambert et al. ..... 148/12.4

FOREIGN PATENT DOCUMENTS 0198216 12/1982 Japan ..... 148/12 R 0422954 1/1935 United Kingdom ..... 148/12 R

OTHER PUBLICATIONS

*Physical Metallurgy Principles* Reed-Hill pp. 687-690 12/73.

*Primary Examiner*—L. Dewayne Rutledge

*Assistant Examiner*—S. Kastler

*Attorney, Agent, or Firm*—Holman & Stern

[57] ABSTRACT

At the exit from the hot rolling mill the rail temperature is reduced to a value not less than that at which the pearlite transformation begins in the rail head. From this temperature the continuously advancing rail is subjected to rapid cooling in a rapid cooling line. Subsequently the rail is cooled to ambient temperature. For a given rail head temperature at the extreme to the rapid cooling line, the length of the line, the speed of advance of the rail, and the average thermal flux density applied to the head, flange, and web of the rail are controlled so that the final mechanical properties of the rail head are obtained, although less then 60% of the cross-section of the head has undergone the austenite-pearlite transformation upon leaving the rapid cooling line, and differences in elongation between the head and the web and between the head and the flange are minimized.

7 Claims, 10 Drawing Figures

METHOD AND APPARATUS FOR MANUFACTURING RAILS

The invention relates to a method of manufacturing rails, more particularly high-strength rails, comprising heat treatment of the rails as soon as they leave the last stand in the rolling mill, that is, while they are still hot from rolling, and to apparatus for carrying out this method.

An object of the invention is to provide, preferably without adding alloying elements to the steel, rails which after cooling exhibit high breaking strength, wear resistance, high impact strength, elongation of at least 10%, and good weldability.

High-strength steels are understood in particular to include steels containing 0.4% to 0.85% C, 0.4% to 1% Mn and 0.1% to 0.4% Si, and preferably 0.6% to 0.85% C and 0.6% to 0.8% Mn; these steels may on occasion contain up to 1% Cr or up to 0.3% Mo or up to 0.15% V. Still within the scope of the invention, however, the method may be applied to steels of which the carbon and manganese contents are between 0.4% and 0.6%, and which do not contain alloying elements.

It is known that to obtain a rail with the properties listed it is necessary for the rail head to be of fine pearlite free of proeutectoid ferrite and of martensite and possibly containing a certain percentage of bainite, and for the hardness gradient in the rail head to be as gentle as possible.

To this end it has been proposed, more particularly in Belgian Pat. No. 854834, that the rail should undergo heat treatment with its head and flange being cooled in different manners. In accordance with this Belgian specification, the rail head is subjected to accelerated cooling by quenching in mechanically agitated boiling water, whereas the flange is cooled in air or in calm water at 100° C.

While this known method does make it possible to minimise permanent deformation of the rails, implementation of it on an industrial scale presents some technological difficulties.

In addition, it may cause marked transitory deformation of the rail during treatment, which is liable to give rise to some permanent deformation.

To eliminate the disadvantages mentioned, the Applicants proposed another method, consisting in reducing the rail temperature at the exit from the hot rolling mill to a value not less than that at which the pearlite transformation begins in the rail head; from this temperature, the continuously advancing rail is subjected to rapid cooling until at least 80% of the allotropic austenite-pearlite transformation has taken place in the rail; and the rail is then cooled to ambient temperature.

This method, described in Luxembourg Pat. No. 84417 of Nov. 10, 1982, gives useful results, but requires a fairly long treatment time.

During subsequent work the Applicants then perfected an original method comprising a much shorter heat treatment phase than that required for the previous process, combining a method of cooling the rail head which gives the desired mechanical characteristics, with a method of cooling the rail flange and web which ensures straightness of the rail, during and after heat treatment.

The method in accordance with the invention is based on the unexpected discovery that the desired properties can be imparted to the rail without completing allotropic transformation in its head during the intense cooling treatment; it is perfectly possible to impart these properties even with relatively short treatment times, provided that different parts of the rails are subjected to cooling at suitably selected intensities.

BRIEF DESCRIPTION OF DRAWINGS

The accompanying FIGS. 1, 2, and 3 illustrate the application of this basic principle underlying the method in accordance with the present invention, and indicate how properties (by way of example, the breaking load) are obtained while a large part of the rail head is still in an austenitic state.

In FIG. 1, which is a temperature/time diagram, curve A represents the variation in temperature at a point 14 mm below the upper surface of the rail head, during the rapid cooling phase (I) and during the gentle coolin phase on the normal cooler (II).

FIG. 2 illustrates, at two different times during a heat treatment in accordance with the invention, the state of the austenite/pearlite transformation in the rail head (V in %), from its top surface to its bottom surface (distance d between 0 and 35 mm). Curve B represents the degree of this allotropic transformation at the exit from the rapid cooling device and curve C this degree 25 seconds after the end of this cooling.

These FIGS. 1 and 2 illustrate the results obtained by proceeding according to the principle mentioned above, under the following conditions:

type of rail: EB 50 T;

temperature of rail on entering rapid cooling line: 875° C.;

length of cooling line: 18 m;

speed of advance of rail: 0.53 m/s;

average thermal flux density at upper surface of rail head: 1.15 $MW/m^2$;

average thermal flux density at lower surface of rail head: 0.10 $MW/m^2$;

composition of steel: C: 0.63%, Mn: 0.65%.

The rail head is equivalent to a flat object cooled intensively on its top surface and moderately on its bottom surface ($\Phi_{top}/\Phi_{bottom}=11.5$).

Figure 1:
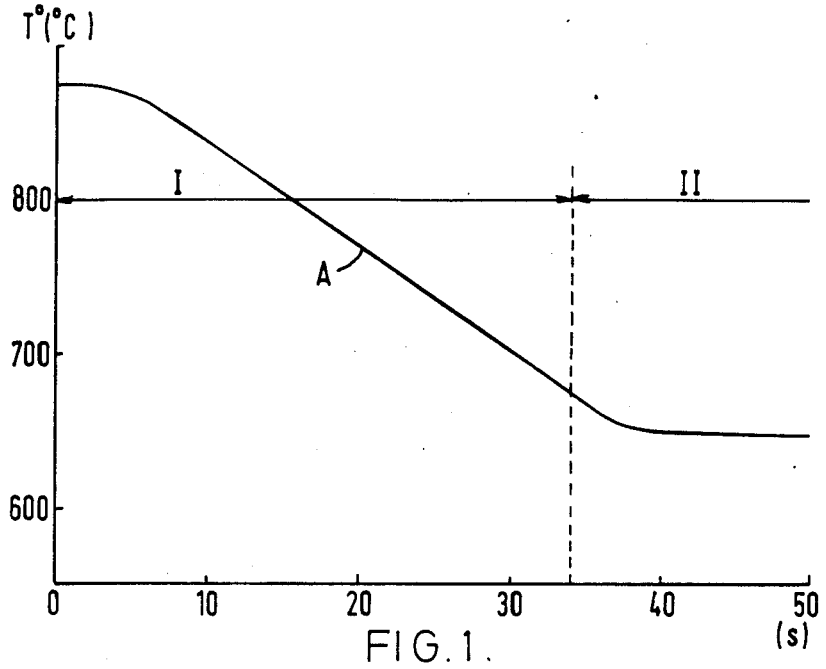
FIG. 1 shows a temperature (T°)/time(s) diagram during different cooling phases.
Figure 2:
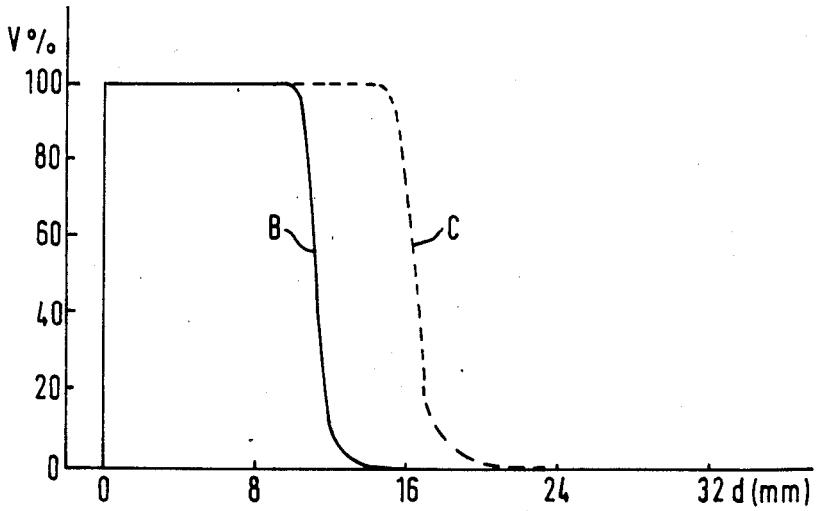
FIG. 2 shows the state of austentite/pearlite transformation at different times.

It is found (FIG. 1) that a depth of 14 mm (the depth at which standard tensile test specimens are taken) the rate of cooling is 6.8° C./s and the temperature at the end of treatment is 675° C. FIG. 2 shows that, at a depth of 14 mm, transformation has hardly begun at the end of treatment; despite this the properties obtained at this depth were of the desired values.

FIG. 2 also shows that at the end of the rapid cooling phase only 32% by volume of the rail head was transformed, whereas 25 seconds after the end of treatment the percentage had risen to approximately 47%.

Figure 3:
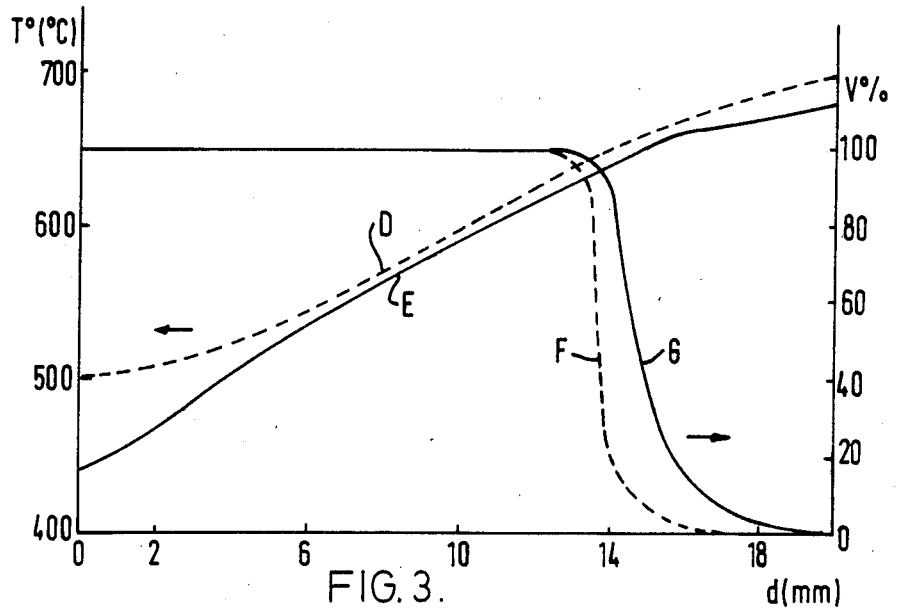
FIG. 3 represents both the distribution of temperature and the state of transformation.

FIG. 3 represents both the distribution of temperatures (°C.) in the rail head and the state of the allotropic transformation (%) at the exit from the rapid cooling device. The distances between the points concerned and the top surface of the rail head (mm) are plotted as abscissae.

Curves D and E illustrate the temperature distribution and curves F and G represent the degree of allotropic austenite-pearlite transformation, under the following practical conditions:

Test No. 19 (curves E and G):
steel 0.77 C—0.68 Mn—0.22 Si
entry temperature of rail head: 810° C.
treatment time for section concerned: →51 sec
total water flow rate in the cooling line: 34.2 $m^3/h$
average thermal flux density at top surface of rail head: 0.70 $MW/m^2$
rail type: EB 50 T.

Result: breaking load 14 mm below top surface of rail head: 1090 MPa.

Test No. 20 (curves D and F):
steel 0.77 C—0.68 Mn—0.22 Si
entry temperature of rail head: 865° C.
treatment time for section concerned: →49 sec
total water flow rate in the cooling line: 40.2 $m^3/h$
average thermal flux density at top surface of rail head: 0.814 $MW/m^2$
rail type: EB 50 T.

Result: breaking load B 14 mm below top surface of rail head: 1080 MPa.

FIG. 3 shows that, for example for Test No. 20, the pearlite formed in the rail head at the exit from the cooling line occupies only about 42% of the volume of the head.

The fact that the desired properties are obtained without transformation in the rail head being complete is of great practical importance, since it means that for a given hourly output the cooling line can be shorter and hence the investment costs can be reduced.

To put the basic principles of the method in accordance with the invention into practice, the thermal cycle which is imposed on the rail head in the cooling installation, and which is selected on the basis of metallurgical considerations, is applied in particular and selective manners to the top and bottom parts of the head, while the cooling of the rail web and flange is controlled as a function of the transitory deformations of the rail during treatment. This is because experience has shown that, without such control, deflection of the rail during treatment is so great that any mechanical guiding becomes impractical and application of the heat treatment to the rail becomes impossible.

It is the combination of the two features which makes it possible to produce, very economically, a rail which fulfills requirements as regards both its mecanical properties and the geometrical aspect of the end product.

During the rapid cooling phase, according to an essential aspect of the method of the invention, the upper part of the rail head is cooled intensively in order to produce the allotropic austenite-pearlite transformation in this part (possibly with the admixture of bainite), while the lower part of the head is cooled much less, in order to preserve the austenitic state in this part. During this rapid cooling phase the other parts of the rail are also cooled in order to match expansions.

Following the principles set out above, the method of manufacturing rails according to the present invention, in which at the exit from the hot rolling mill the rail temperature is reduced to a value not less than that at which the pearlite transformation begins in the rail head and, from this temperature, the continuously advancing rail is subjected to rapid cooling and the rail is then cooled to ambient temperature, is essentially characterised in that for a given rail head temperature at the entrance to the rapid cooling line, the length of the line, the speed of advance of the rail and the average thermal flux density applied to the rail head, flange and web are controlled in such a way that, on the one hand, the final mechanical properties in the rail head are obtained when, at the exit from the said cooling line, less than 60% of the cross-section of the rail head has undergone the allotropic austenite-pearlite transformation, and, on the other hand, differences in elongation between the rail head and the web and between the rail head and the flange are minimised.

During the slow cooling phase which follows the rapid cooling phase, the temperature in the rail head becomes more uniform; the temperature diminishes in the lower part of the head due to lose of heat to the colder adjacent parts of the rail, that is, to the upper part of the head and to the web. The residual austenite is also transformed into pearlite, and the entire rail then has the desired microstructure.

According to a particular embodiment of the method in accordance with the invention, cooling is controlled in such a way that there is no martensite in the rail head.

With the invention, choosing the length of the rapid cooling line and the speed of rail advance in this line amounts to fixing the duration of the treatment in question. These values are related to the choice of the average thermal flux density applied to the surface of the rail head during the heat treatment.

In a known method of manufacturing rails, described for example in European Patent Application No. 0098492, it is recommended that the advancing rail undergo intense cooling in an installation comprising a series of water spraying zones separated by air cooling zones.

To perform this method, therefore, the water nozzles must be grouped in zones separated by air cooling sections. This arrangement makes for a very long cooling line which may be difficult to incorporate in an existing rolling mill.

Performance of the method in accordance with the invention, on the other hand, revealed unexpectedly that it was not advisable to arrange the water nozzles in groups separated by air cooling sections. A uniform and uninterrupted arrangement of the nozzles along the cooling line will give the desired properties while preventing martensite. This uniform arrangement of water nozzles is particularly advantageous because it enables very short cooling lines to be used.

This particular feature of the method in accordance with the invention is based on the Applicants' work on the cooling effect of the various devices suitable for performing the method, more particularly a nozzle of a given type placed at a certain height relative to the cooled surface and supplied with water at a known flow rate and temperature.

Figure 4:
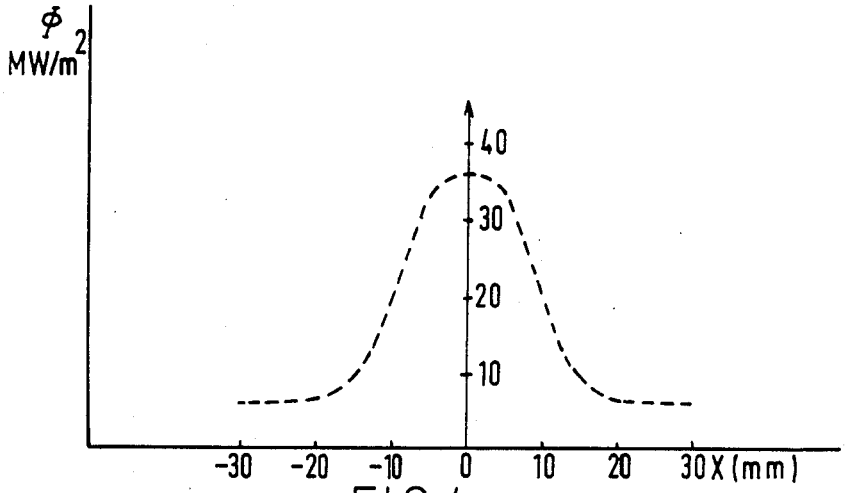
FIG. 4 illustrates the relationship of thermal flux density and the distance from the plane of symmetry of the nozzle.

The thermal flux density removed at the cooled surface at a point ($x_1$, $y_1$) on this surface depends essentially on the temperature of this surface: $\Phi=f(T_s)$. For a given value of $T_s$, the flux depends also on the co-ordinates (x, y). FIG. 4 illustrates the variation of ($\Phi$) with (x) when y=0 and for a flat nozzle for which the plane Oyz selected is the plane of symmetry of the nozzle. The flux is found to diminish very rapidly as the distance from the plane of symmetry of the nozzle increases, even though the water spreads out on the cooled surface over a fairly large distance from that plane of symmetry.

Figure 5:
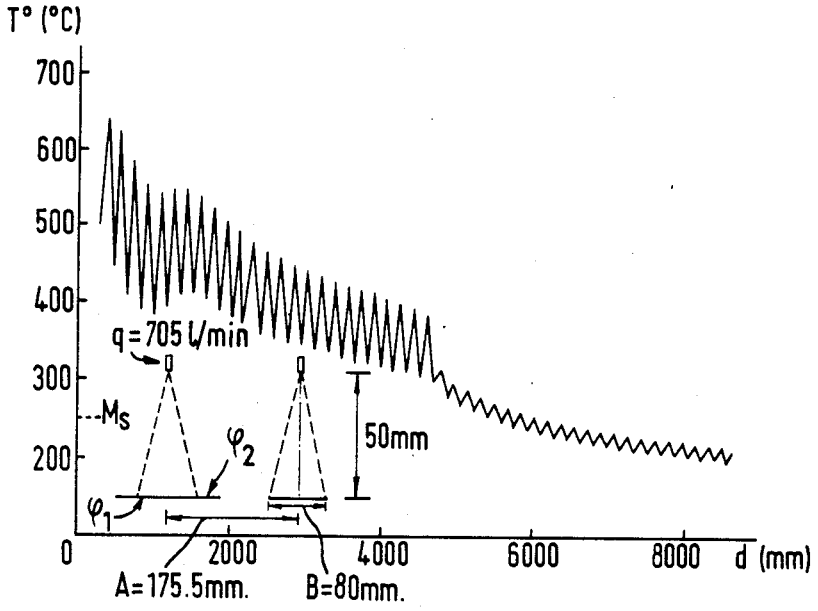
FIG. 5 illustrates the variation in surface temperature of a railhead moving through a cooling installation.

FIG. 5 illustrates, for a rail of which the head is cooled while moving through an installation with equispaced nozzles 175.5 mm apart, the variation in surface temperature of the head in the central part of the cooling installation. As soon as the plane of symmetry of a nozzle is left, the surface temperature of the head rises, despite the fact that, with the nozzle arrangement for this Figure, all the surface of the head between two consecutive nozzles is under water. Also, the temperature at which martensite formation begins (250° C. for the steel concerned) is not reached.

Figure 6:
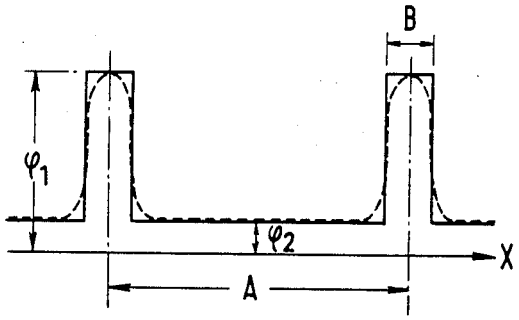
FIG. 6 represents the variation in thermal flux at different zones.

In a simplified representation which may be adopted, the variation in thermal flux along the cooling line at a given surface temperature is indicated diagrammatically as shown in FIG. 6, in which nevertheless two types of cooling on the top surface of the rail head are considered:

(a) the zones B which are directly affected by the nozzles, and for which values $\Phi_1(t)$ are used which constitute the spatial mean in the impact zone and for each temperature;

(b) the zones A between nozzles; these zones are under water, but measurements demonstrated that the thermal flux is distinctly less there than under the nozzles, at least within the heating region. Also, the transition from heating to nucleated boiling is relatively abrupt in these zones.

This simplification ignores the variation in flux according to y, experience having shown that this variation is small.

The concept of average thermal flux density ($\overline{\Phi}$) (or, for brevity, the term "average flux") will be used hereafter in defining the scope of the invention.

The average flux ($\overline{\Phi}$) may defined as follows, (x, $T_s$) being known (x=distance from entrance to cooling line and $T_s$=temperature of surface of rail head), and an arbitrary value being chosen for $T_s$, $T_s=T^*_s$:

$$\overline{\Phi} = \frac{1}{A}\int_O^A \Phi(x, T_s^*)dx$$

wherein A is the distance between two consecutive nozzles.

In principle, $\overline{\Phi}(350)=1.32$ MW/m$^2$ will represent the head cooling intensity reasonably correctly provided that the average temperature of the top surface of the head does not deviate too far from $T^*_s=350°$ C., as is the case in FIG. 5.

If the amplification in FIG. 6 is adopted, this gives:

$$\overline{\Phi}(T_s^*) = \Phi_1(T_s^*)\left\{\frac{B}{A} + \left(1 - \frac{B}{A}\right)\frac{\Phi_2(T_s^*)}{\Phi_1(T_s^*)}\right\} \quad (\alpha)$$

wherein $\Phi_1$ is the average flux value in the zone directly affected by the nozzles, $\Phi_2$ is the average flux value in the zone immersed but not sprayed, between nozzles, A the distance between nozzles, and B the width of the zone sprayed by a nozzle; the values of these parameters are known since the installation concerned is known.

The average flux value having been determined by means of equation ($\alpha$), all that remains before the method of the invention can be applied is to find the value for the duration ($\tau$) of the rapid cooling phase, taking into account, of course, the composition of the steel, the properties desired in the rail, and the general characteristics of the installation available.

In a particular embodiment of the method of the invention, the concept of "mean transformation temperature" (abbreviated as TMT) is advantageously used.

In the course of their work the Applicants found that, while parameters such as the average cooling rats or the average temperature at the end of controlled cooling affect the mechanical properties of the rail head, the parameter which directly and unambiguously controls these properties is this "mean transformation temperature".

Within the scope of the invention, this TMT temperature has been defined as follows. A point in the section of the rail head is considered (in the ensuing examples, a point situated on the plane of symmetry of the rail and 14 mm from the surface of the reail head—the point at which standard tensile test specimens are taken), of which the temperature varies during and after treatment in accordance with the equation:

$$T=f_1(t) \quad (1)$$

In addition, the kinetics of the allotropic transformation at this point are described by:

$$z=f_2(t) \quad (2)$$

wherein Z represents the percentage by volume of transformed austenite.

Combination of these two kinetic relations gives: $T=f_3(z)$, whence $$TMT = \int_0^1 f_3(z)dz \quad (3)$$

Figure 7:
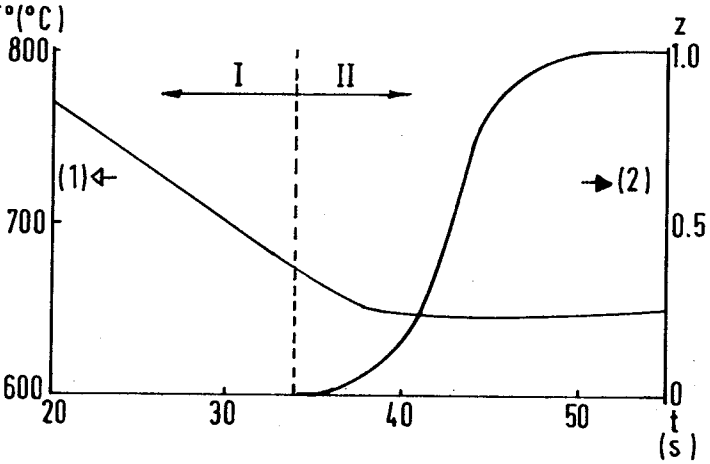
FIG. 7 represents the relationship of temperature and Z as a function of the time during the two phases of rapid cooling in the upper and part and the relationship of z/t° in the lower part.
Figure 7:
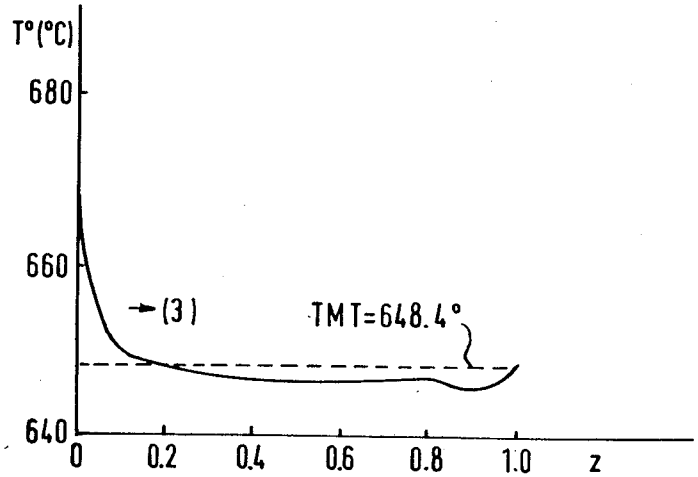

In FIG. 7, the relations (1) and (2) are shown in the upper part (temperature and z as a function of time) during the two phases of rapid cooling (I) and air cooling (II), whereas relation (3) is represented in the lower part (diagram z/T°).

In view of the remarkable fact that there is a close and unique relation between the mechanical properties and the TMT temperature, the Applicants advocate that the values of $\Phi$ and of $\tau$ be determined using as the sole parameter this temperature, which, for a steel of a given composition, will then be the only variable from which the mechanical properties depend.

Figure 8:
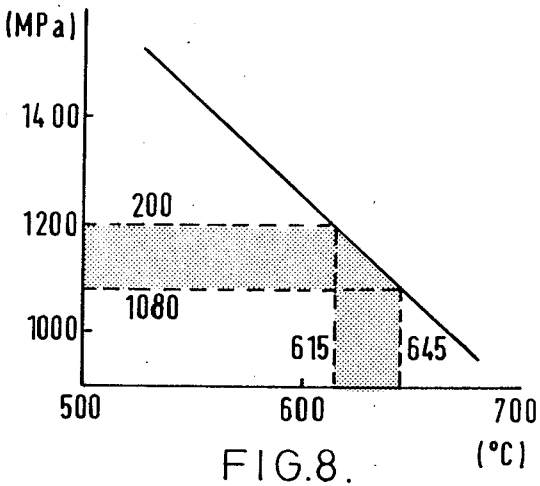
FIG 8 shows the relationship of breaking load and TMT temperature.

FIG. 8 shows an example of the relation between the breaking load and the TMT temperature for a steel comprising 0.75% C and 0.72% Mn. This relationship is very important both to the definition of the thermal cycle and to the control of the process.

For a given steel, the "breaking load/TMT" relation makes it possible to determine (TMT) min and (TMT) max from maximum and minimum values respectively for the breaking loads desired in the rail head, for example (in the case of FIG. 8) values (TMT) min=615° C. and (TMT) max=645° C. if the breaking load is to be between 1080 and 1200 MPa (steel with 0.75% C and 0.72% Mn).

For a particular case, it is possible to determine a region of variation of the two parameters $\overline{\Phi}$, $\tau$ which define the cooling conditions. The given conditions of the case are as follows:

the composition of the steel;

the range of mechanical properties desired and hence the maximum and minimum values of the mean transformation temperature;

the maximum temperature of the rail head entering the cooling line, as a function of the temperature at the end of rolling and therefore the installation;

the minimum temperature of the rail head entering the cooling line—this temperature must exceed the temperature at which transformation begins, in order to prevent the formation of soft structures in the surface of the rail head.

There are also two constraints:

no martensite must form in the rail head; and there must be no more than 60% austenite transformation in the cross-section of the rail head at the exit from the cooling line.

Figure 9:
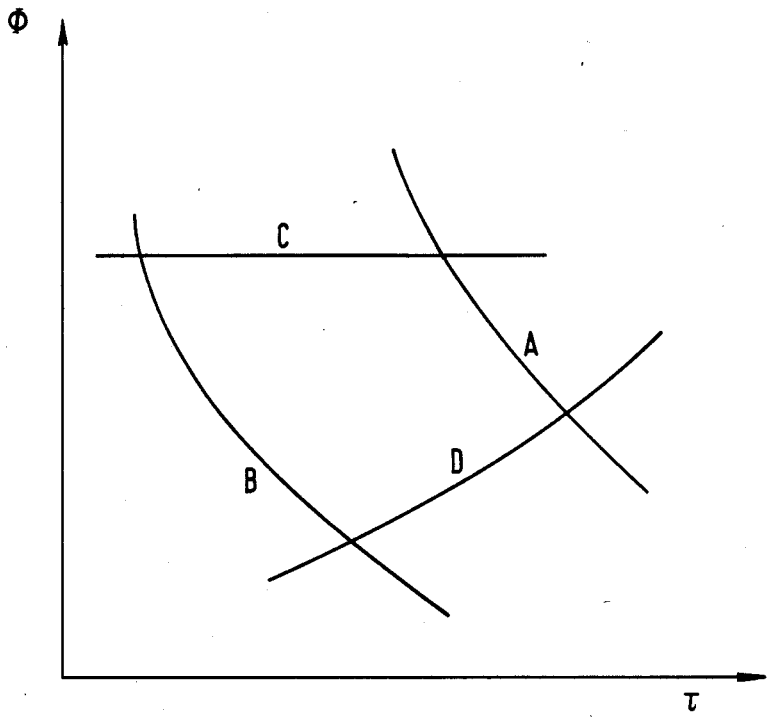
FIG. 9 is a diagrammatic representation of the region of variation of $\Phi$ and $\tau$.

FIG. 9 gives a diagrammatic representation of the region of variation of $\overline{\Phi}$ and $\tau$. In this Figure:

Curve A corresponds to a maximum entry temperature and a minimum mean transformation temperature;

Curve B corresponds to a minimum entry temperature and a maximum mean transformation temperature;

Curve C corresponds to the maximum flux for which no martensite forms in the cross-section of the rail head; and Curve D corresponds to the quenching time for which the percentage of transformed austenite at the exit from the cooling line is 60%.

A diagram of this kind must be created for every case. It can be calculated by means of a mathematical model, for example the following simple model:

$$\tau = a\overline{\Phi}T_o + bT_o + c\overline{\Phi} + d \qquad (\beta)$$

wherein $\tau$=duration of treatment (s), $\overline{\Phi}$=mean flux (MW/m$^2$), $T_o$=initial temperature of rail head, a, b, c, d=coefficients depending on composition and type of rail and on value intended for mean transformation temperature TMT.

For example, for TMT=645° C., a rail EB 50 T and a steel containing 0.63% c-0.65% Mn, the values are as follows:

$a = -0.095$ m$^2$s °C.$^{-1}$ MW$^{-1}$ $b = 0.185$ s °C.$^{-1}$ $c = 52.6$ m$^2$s MW$^{-1}$ $d = -100$ s so finally the duration $\tau$ of treatment is obtained.

In an advantageous embodiment of the method in accordance with the invention, the web and flange of the rail are cooled by water nozzles similar to those used for the rail head. The average flux desired is obtained by controlling the distance between nozzles and the flow rate of water through the nozzles. These two parameters can be adjusted separately for the web and the flange.

Industrial tests have demonstrated, however, that whatever the care taken in controlling the cooling of the three parts of the rail (head, flange, and web), some transitory deformation of the rail is inevitable, chiefly due to differences in the initiation and development of the allotropic transformation in the three parts of the rail.

This tendency to transitory deformation makes guiding of the rail during treatment essential, but also difficult.

In the course of their work the Applicants have developed an effective guiding mechanism, of which the essential features are as follows:

guiding of the rail in the vertical plane is effected not by pairs of rollers of which the axes of rotation are situated in a plane perpendicular to the advance of the rail, but by offset rollers preferably grouped in threes;

the diameter of the rollers which guide in the horizontal plane is between 0.5 and 1.5 times the distance between two successive rollers;

guiding the horizontal plane is effected in that rollers having vertical axes and situated between the vertical-guiding roller groups bear on the lateral surfaces of the rail head.

Figure 10:
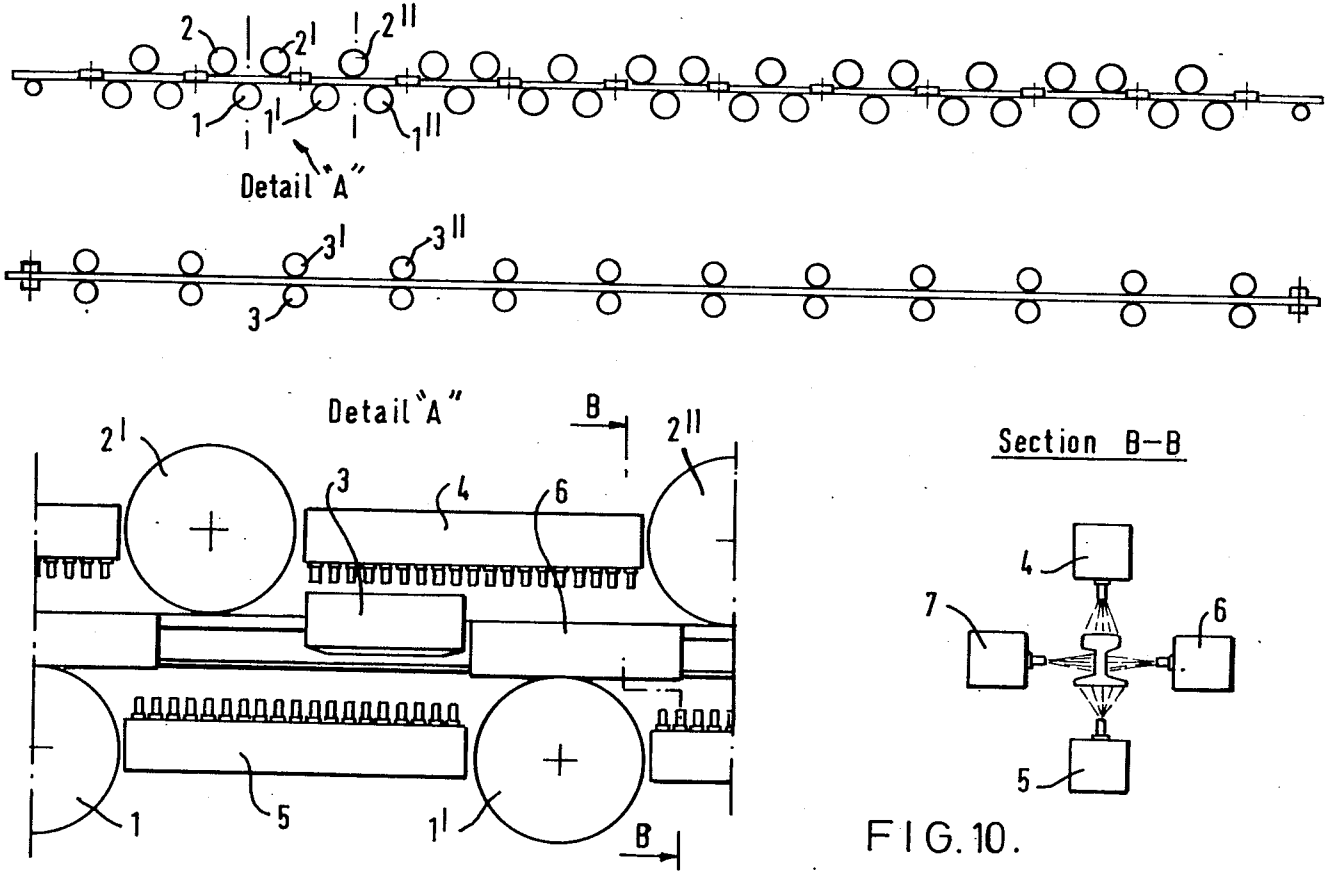
FIG. 10 illustrates an embodiment of the apparatus in accordance with the present invention.

FIG. 10 illustrates an embodiment of the principles described above. Some of the guiding sets may also be used as means for driving the rail at adjustable speed.

In FIG. 10, the rollers 1, 1', 1'', . . . placed against the rail flange and the rollers 2, 2', 2'', . . . placed against the top surface of the rail head provide "vertical" guiding, whereas the rollers 3, 3', 3'', . . . bearing on the sides of the rail head provide "horizontal" guiding.

In a particular embodiment of the apparatus in accordance with the invention, some or all of the guide rollers are made to bear on the rail with forces of which the values are pre-selected so as to tolerate some deformation of the rail during heat treatment. In the case of such an embodiment of the apparatus, it is advantageous to leave the rollers which bear on the rail with a pre-set force (for example, the rollers 2, 2', 2'' in FIG. 10) some mobility in the guiding plane, whereas the remaining rollers (for example, rollers 1, 1', 1'' in FIG. 10) are "fixed in space".

The position of the rollers which bear on the rail with a pre-set force can be measured to determine the deformation of the rail during treatment. With the aid of a model of the process, the computer adjusts cooling separately for the web and flange so as to minimise deformation of the rail during treatment.

This alteration in the cooling of the web and flange to minimise rail deformation can be done equally well in the vertical or horizontal plane.

FIG. 10 also shows the cooling headers equipped with nozzles, wetting respectively the top surface of the head (header 4), the underside of the flange (header 5), and the two sides of the web (headers 6 and 7).

We claim:

1. A method of manufacturing steel rail using a hot rolling mill, including reducing the rail temperature immediately after the exit from the hot rolling mill to a value not less than that at which the pearlite transformation begins in the rail head; subjecting the continuously advancing rail to a rapid cooling step from this temperature and then cooling the rail to the ambient temperature, the improvement comprising controlling the cooling time and the average thermal flux density applied to the rail head during said rapid cooling step so that less than 60% of the austenite-pearlite transformation has occurred in the rail head at the end of said rapid cooling step, and controlling the average thermal flux density applied to the web and to the flange of the rail during said rapid cooling step so that their respective thermal elongation presents a minimum difference with respect to the thermal elongation of the rail head.

2. The method as claimed in claim 1, further comprising controlling the rapid cooling so that there is no martensite in the rail head.

3. The method as claimed in claim 1, in which water nozzles are disposed uniformly and uninterruptedly along the rapid cooling line without being separated by air cooling zones.

4. The method as claimed in claim 1 in which the average thermal flux density, $\overline{\Phi}$, applied to the rail head is determined from the relation $$\overline{\Phi}(T_s^*) = \Phi_1(T_s^*)\left\{\frac{B}{A} + \left(1 - \frac{B}{A}\right)\frac{\Phi_2(T_s^*)}{\Phi_1(T_s^*)}\right\}$$

wherein $T_s^*$ is an arbitrarily selected average temperature for the upper surface of the rail head, $\Phi_1$ is the average flux value in the zone directly affected by the nozzles, $\Phi_2$ is the average flux value in the zone immersed but not sprayed, between nozzles, A the distance between nozzles, and B the width of the zone sprayed by a nozzle.

5. The method of manufacturing steel raid as claimed in claim 1 further comprising guiding the rail in the vertical plane and in the horizontal plane during said rapid cooling step, the guiding of the rail in the vertical plane being effected by groups of offset rollers and the guiding of the rail in the horizontal plane being effected by rollers having vertical axes which are situated between the vertical-guiding roller groups and which bear on the lateral surface of the rail head.

6. The method as claimed in claim 5, wherein at least some of the guide rollers are made to bear on the rail with forces preselected so as to allow some deformation of the rail during heat treatment.

7. A method of manufacturing steel rail using a hot rolling mill, including reducing the rail temperature immediately after the exit from the hot rolling mill to a value not less than that at which the pearlite transformation begins in the rail head; subjecting the continuously advancing rail to a rapid cooling step from this temperature and then cooling the rail to the ambient temperature, the improvement comprising controlling the cooling time and the average thermal flux density applied to the rail head during said rapid cooling step so that less than 60% of the austenite-pearlite transformation has occurred in the rail head at the end of said rapid cooling step, and controlling the average thermal flux density applied to the web and to the flange of the rail during said rapid cooling step so that their respective thermal elongation presents a minimum difference with respect to the thermal elongation of the rail head wherein the duration of the rapid cooling is calculated from the value of the mean transformation temperature by a formula:

$$\tau = a\overline{\Phi}T_o + bT_o + c\Phi + d$$

wherein $\tau$ = duration of treatment, $\overline{\Phi}$ = average thermal flux density, $T_o$ = temperature of rail head on entering the rapid cooling line, a, b, c, d = coefficients depending on the composition and type of rail and on the value of the mean transformation temperature.

* * * * *